US009879632B2

(12) United States Patent
Smith

(10) Patent No.: US 9,879,632 B2
(45) Date of Patent: Jan. 30, 2018

(54) METHOD OF CONTROLLING FUEL TO BE INJECTED WITHIN A COMBUSTION ENGINE

(71) Applicant: Perkins Engines Company Limited, Cambridgeshire (GB)

(72) Inventor: Michael Smith, Cambridgeshire (GB)

(73) Assignee: Perkins Engines Company Limited, Peterborough (GB)

( * ) Notice: Subject to any disclaimer, the term of this patent is extended or adjusted under 35 U.S.C. 154(b) by 407 days.

(21) Appl. No.: 14/404,277

(22) PCT Filed: Jun. 20, 2013

(86) PCT No.: PCT/GB2013/051622
§ 371 (c)(1),
(2) Date: Nov. 26, 2014

(87) PCT Pub. No.: WO2014/001767
PCT Pub. Date: Jan. 3, 2014

(65) Prior Publication Data

US 2015/0144107 A1 May 28, 2015

(30) Foreign Application Priority Data

Jun. 27, 2012 (GB) ..... 1211412.0

(51) Int. Cl.
*F02D 41/34* (2006.01)
*F02D 41/00* (2006.01)
*F02D 41/30* (2006.01)

(52) U.S. Cl.
CPC ..... *F02D 41/34* (2013.01); *F02D 41/008* (2013.01); *F02D 41/30* (2013.01)

(58) Field of Classification Search
CPC ..... F02D 41/008; F02D 41/30; F02D 41/34; F02D 41/36; F02D 41/365;
(Continued)

(56) References Cited

U.S. PATENT DOCUMENTS 4,368,705 A * 1/1983 Stevenson ..... F02D 41/2422 123/357
4,814,992 A 3/1989 Sakurai et al.
(Continued)

FOREIGN PATENT DOCUMENTS

CN 101903629 12/2010
DE 19746855 A1 4/1999
(Continued)

OTHER PUBLICATIONS

European Patent Office, International Search Report in International Patent Application No. PCT/GB2013/051622, dated Nov. 22, 2013, 2 pp.
(Continued)

*Primary Examiner* — Carlos A Rivera
*Assistant Examiner* — Carl Staubach

(57) ABSTRACT

A method of controlling the injection of fuel into cylinders of an internal combustion engine provides a method of distributing injection of fuel among cylinders of the engine so as to inject a quantity of fuel which is reliable and accurate, even when the quantity of fuel for each cylinder is close to the minimum quantity which can reliably and accurately be injected. The method may be applicable to injection of fuel for combustion in the engine or injection of fuel which is timed to be injected so as to pass through the cylinder without combusting.

20 Claims, 3 Drawing Sheets

(58) Field of Classification Search
CPC ..... F02D 41/0087; F02D 41/2422; F02D 41/345; F02D 41/401; F02D 41/405; F02D 41/102; F02D 41/247
USPC ..... 701/101, 103, 104, 105; 123/445, 458, 123/480, 481, 486, 496, 673
See application file for complete search history.

(56) References Cited

U.S. PATENT DOCUMENTS

| | | | | |
|---|---|---|---|---|
| 5,076,238 | A * | 12/1991 | Rosenau | F02D 41/061 123/491 |
| 5,732,381 | A | 3/1998 | Guido et al. | |
| 6,360,724 | B1 * | 3/2002 | Suhre | F02D 17/02 123/198 F |
| 6,446,602 | B1 | 9/2002 | Yonezawa et al. | |
| 6,550,457 | B1 | 4/2003 | Kitagawa et al. | |
| 7,395,807 | B2 | 7/2008 | Watanabe | |
| 7,650,875 | B2 | 1/2010 | Idogawa et al. | |
| 9,200,587 | B2 * | 12/2015 | Serrano | F02D 45/00 |
| 2007/0078588 | A1 * | 4/2007 | Thompson | F02D 41/2409 701/115 |
| 2009/0164095 | A1 | 6/2009 | Geveci et al. | |
| 2010/0043744 | A1 * | 2/2010 | Suzuki | F02B 77/08 123/260 |
| 2010/0100304 | A1 | 4/2010 | Yasui et al. | |
| 2013/0006497 | A1 * | 1/2013 | Silvers | F02D 41/3058 701/103 |
| 2016/0252023 | A1 * | 9/2016 | Srinivasan | F02D 41/2422 |

FOREIGN PATENT DOCUMENTS

| | | | |
|---|---|---|---|
| DE | 10014553 | A1 | 10/2001 |
| DE | 102008002265 | A1 | 1/2009 |
| JP | 07-103052 | A | 4/1995 |
| JP | 2000-110642 | A | 4/2000 |
| JP | 2002-213287 | A | 7/2002 |
| JP | 2008-101528 | A | 5/2008 |
| JP | 2009-013952 | A | 1/2009 |
| JP | 4551425 | | 9/2010 |
| JP | 4782078 | | 9/2011 |
| WO | WO 2007/057268 | A1 | 5/2007 |

OTHER PUBLICATIONS

UK Intellectual Property Office, Search Report in UK Patent Application No. GB1211412.0, dated Oct. 26, 2012, 1 p.

* cited by examiner

| count | Fractional value | | | | | | | | | | | | |
|---|---|---|---|---|---|---|---|---|---|---|---|---|---|
| | 1/26 | 3/26 | 5/26 | 7/26 | 9/26 | 11/26 | 1/2 | 15/26 | 17/26 | 19/26 | 21/26 | 23/26 | 25/26 |
| 1 | 0 | 0 | 0 | 0 | 1 | 0 | 0 | 0 | 0 | 1 | 0 | 0 | 0 |
| 2 | 0 | 0 | 0 | 1 | 0 | 0 | 1 | 1 | 1 | 1 | 1 | 1 | 1 |
| 3 | 0 | 0 | 0 | 0 | 0 | 1 | 0 | 0 | 1 | 1 | 1 | 1 | 1 |
| 4 | 0 | 0 | 1 | 0 | 1 | 0 | 1 | 1 | 0 | 0 | 1 | 1 | 1 |
| 5 | 0 | 0 | 0 | 0 | 0 | 1 | 0 | 0 | 1 | 1 | 0 | 1 | 1 |
| 6 | 0 | 0 | 0 | 1 | 0 | 0 | 1 | 1 | 0 | 1 | 1 | 1 | 1 |
| 7 | 0 | 1 | 0 | 0 | 1 | 0 | 0 | 0 | 1 | 0 | 1 | 0 | 1 |
| 8 | 0 | 0 | 0 | 0 | 0 | 1 | 1 | 1 | 1 | 1 | 1 | 1 | 1 |
| 9 | 0 | 0 | 0 | 0 | 0 | 0 | 0 | 1 | 0 | 1 | 0 | 1 | 1 |
| 10 | 0 | 0 | 0 | 1 | 1 | 1 | 1 | 0 | 1 | 0 | 1 | 1 | 1 |
| 11 | 0 | 0 | 1 | 0 | 0 | 0 | 0 | 1 | 0 | 1 | 1 | 1 | 1 |
| 12 | 0 | 0 | 0 | 0 | 0 | 0 | 1 | 0 | 1 | 1 | 1 | 1 | 1 |
| 13 | 0 | 0 | 0 | 0 | 0 | 1 | 0 | 1 | 1 | 0 | 1 | 1 | 1 |

*FIG. 2*

Fractional value

| count | $\frac{2x_1-1}{2p}$ | $\frac{2x_2-1}{2p}$ | $\frac{2x_3-1}{2p}$ | $\frac{2x_4-1}{2p}$ | $\frac{2x_5-1}{2p}$ | ⋮ | ⋮ | ⋮ | ⋮ | ⋮ | ⋮ | $\frac{2x_{p-1}-1}{2p}$ | $\frac{2x_p-1}{2p}$ |
|---|---|---|---|---|---|---|---|---|---|---|---|---|---|
| $x_1$ | 0 | ... | ... | ... | ... | ... | ... | ... | ... | ... | ... | ... | 1 |
| $x_2$ | 0 | ... | ... | ... | ... | ... | ... | ... | ... | ... | ... | ... | 1 |
| $x_3$ | 0 | ... | ... | ... | ... | ... | ... | ... | ... | ... | ... | ... | 1 |
| $x_4$ | 0 | ... | ... | ... | ... | ... | ... | ... | ... | ... | ... | ... | 1 |
| $x_5$ | 0 | ... | ... | ... | ... | ... | ... | ... | ... | ... | ... | ... | 1 |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| $x_{p-1}$ | 0 | ... | ... | ... | ... | ... | ... | ... | ... | ... | ... | ... | 1 |
| $x_p$ | 0 | ... | ... | ... | ... | ... | ... | ... | ... | ... | ... | ... | 1 |

*FIG. 3*

METHOD OF CONTROLLING FUEL TO BE INJECTED WITHIN A COMBUSTION ENGINE

TECHNICAL FIELD

The disclosure relates to the field of combusting engines and, in particular, to the field of injecting fuel into cylinders of a combustion engine.

BACKGROUND

A combustion engine, such as a diesel engine, may involve injection of fuel, such as diesel fuel, into one or more cylinders of the engine for combustion. In addition to injection of fuel for combustion, fuel may be injected into one or more of the cylinders as a post combustion event with the intention that the fuel passes out of the cylinder or cylinders without oxidising. Such a technique may be useful when the combustion engine is used with an exhaust fluid treatment apparatus. This may allow for unburnt fuel to arrive in the exhaust fluid treatment apparatus. Unburnt fuel may oxidise in the exhaust fluid treatment apparatus which may be useful when there is a desire to increase the temperature in the exhaust fluid treatment apparatus or when there is a desire to burn off, for example, unburnt carbon in the form of soot which may collect in a diesel particulate filter of the exhaust fluid treatment apparatus.

There may be a requirement for the volume of unburnt fuel to be passed through the cylinder to be precise. There may be a limited time between combustion events for injection of fuel which is intended not to oxidise in the cylinder. In the event that the amount of fuel to be passed through the cylinder changes rapidly, there may be a desire for a smooth transition from a first rate of flow of fuel to a second rate of flow of fuel. In addition, there may be a desire to avoid fuel being injected towards the internal walls of the cylinder.

Against this background, there is provided a method of controlling fuel to be injected within a combustion engine.

SUMMARY OF THE DISCLOSURE

A method of controlling injection of a volume of fuel to be injected within a combustion engine, the engine comprising a plurality of cylinders, each cylinder having an associated fuel injector, each fuel injector able to deliver a first injectable fuel volume, wherein each time period comprises a number of possible injection windows, and each possible injection window is associated with one of the plurality of cylinders, wherein each possible injection window is associated with an integer count value, x, between 1 and mp, wherein each of m and p is an integer and wherein x increments by 1 for each possible injection window and wherein mp increments to 1, the method involving use of a matrix having p columns and mp rows wherein each row of the matrix is associated with one of the integer count values from 1 to mp, each column of the matrix is associated with a fraction value, and each column of the matrix comprises an injection sequence associated with its fraction value, the method comprising:

determining whether it is true or false that the volume of fuel to be injected per time period is an exact multiple of a product of the number of possible injection windows per time period and the first injectable fuel volume; and when it is determined to be false, identifying a column of the matrix associated with a fraction value which is close to a remainder value obtained by dividing the volume of fuel to be injected per time period by the product of the number of possible injection windows per time period and the first injectable fuel volume, and using the injection sequence of said column to determine in which of a next mp possible injection windows to inject the first injectable fuel volume.

Embodiments of the disclosure will now be described, by way of example only, with reference to the accompanying drawings in which:

BRIEF DESCRIPTION OF THE DRAWINGS

FIG. 2 shows a specific example of a p×p matrix in the form of a 13×13 matrix for use in the method of the present disclosure; and FIG. 3 shows a more general example of a p×p matrix for use in the method of the present disclosure.

DETAILED DESCRIPTION AND INDUSTRIAL APPLICABILITY

Figure 1:
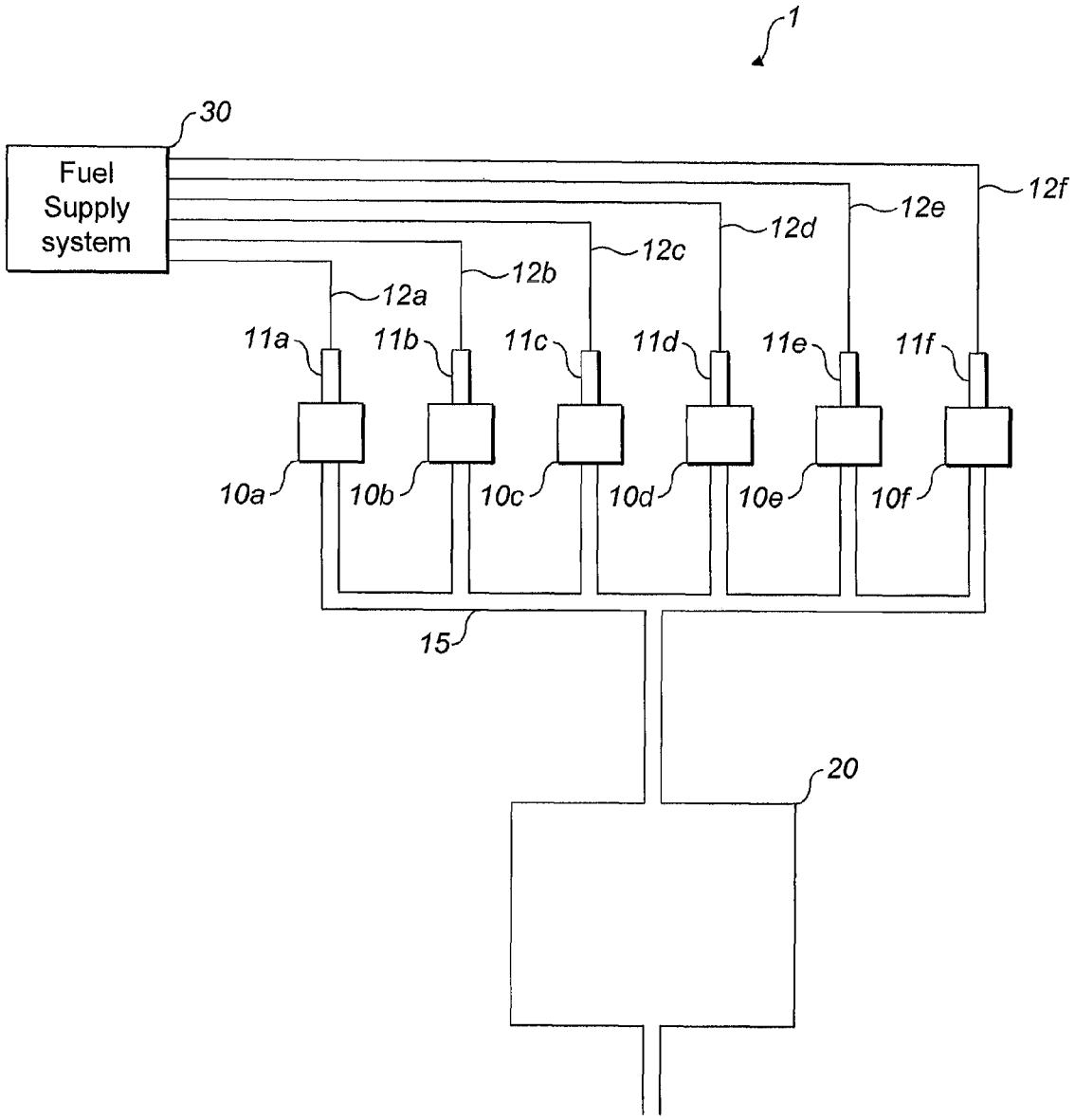
FIG. 1 shows a schematic representation of components of an engine to which the method of the present disclosure may be applied.

To assist in understanding the method in context, before describing the method of the disclosure, the following provides a brief description of an apparatus to which the method may be applied.

Referring to FIG. 1, there is illustrated a combustion engine 1 comprising six substantially similar cylinders 10*a*-10*f*. Each cylinder 10*a*-10*f* may comprise a substantially similar fuel injector 11*a*-11*f* for injecting fuel into the cylinder 10*a*-10*f*. Fuel may be supplied to each injector via a supply line 12*a*-12*f* in communication with a fuel supply system 30. Each fuel injector 11*a*-11*f* may have a minimum volume of fuel which it is considered to be capable of injecting reliably. For example, the minimum volume of fuel may be 5 $mm^3$.

Fuel may be injected into each cylinder 10*a*-10*f* via its respective fuel injector 10*a*-10*f* at a particular point in a stroke of the engine 1 in order to combust in the cylinder 10*a*-10*f*. In addition, fuel may be injected into one or more of the cylinders 10*a*-10*f* by its respective fuel injector 11*a*-11*f* at a different point in the engine stroke with the intention that the fuel will pass directly out of the cylinder 10*a*-10*f* without combusting. This may be useful if it is desired for unburnt fuel to pass into an aftertreatment apparatus 20 for combustion therein.

Volumes of fuel injected may need to be precisely controlled. Furthermore volumes of fuel injected may need to be small by comparison with the preciseness of the volume of each injection achievable by the fuel injectors 11*a*-11*f*. In addition, the timing of fuel injection may need to be carefully controlled. For example, there may be one or more limited time windows of opportunity per engine stroke for injecting fuel to be combusted in the cylinder. Similarly, there may be one or more limited time window of opportunity in each engine stroke for the injection of fuel for the purpose of passing through the cylinder unburnt. The number and duration of windows per second may depend on the speed of the engine.

The method of the present disclosure addresses these requirements.

A flow rate of fuel to be injected into the engine cylinders for burning in the aftertreatment apparatus may be specified by a control system.

The method of the disclosure provides for how to interpret a flow rate of fuel into specific fuel injection events.

The following are examples of how it may be possible to calculate a number of injection windows per second for providing fuel to pass through cylinders unburnt, depending on engine speed and number of cylinders. (It should be noted that each window may comprise zero, one or more than one opportunity for injection of fuel.) Further, the examples show, for a required flow rate of fuel, how it may be possible to determine a desired fractional of injection windows requiring an injection of fuel of the minimum volume which can be reliably injected by each fuel injector.

Example 1

In a first example, a 6-cylinder engine having a four stroke combustion cycle may be rotating at 2000 rpm and the amount of fuel to be injected may be 500 $mm^3$ $s^{-1}$. The minimum volume of fuel reliably injectable per injector may be 5 $mm^3$.

For an engine rotating at 2000 rpm, there will be 100 fuel injection windows per second for the injection of fuel intended to remain unburnt in the cylinders. (2000 rpm/60 s=33.333 revolutions per second. A 6-cylinder engine having a four stroke combustion cycle has 3 injection windows per engine revolution. Therefore, the number of fuel injection windows is calculated as 33.333 revolutions per second×3 injection windows per revolution=100 injection windows per second.)

Each window is associated with one cylinder. (Therefore, for an engine comprising 6 cylinders, there will be 100/6 windows per second per cylinder of the 6-cylinder engine.)

Injecting 500 $mm^3$ $s^{-1}$ may be achieved by injecting the minimum volume reliably achievable by each fuel injector (5 $mm^3$) at every one of the 100 windows per second. (5 $mm^3$×100 windows per second=500 $mm^3$ $s^{-1}$.)

Example 2

In a second example, a 6-cylinder engine may be rotating at 1000 rpm and the amount of fuel to be injected may be 250 $mm^3$ $s^{-1}$. The minimum volume of fuel reliably injectable per injector may be 5 $mm^3$.

For an engine rotating at 1000 rpm, there will be 50 fuel injection windows per second for the injection of fuel intended to remain unburnt in the cylinders. (1000 rpm/60 s=16.667 revolutions per second. A 6-cylinder engine having a four stroke combustion cycle has 3 injection windows per engine revolution. Therefore, the number of fuel injection windows is calculated as 16.667 revolutions per second×3 injection windows per revolution=50 injection windows per second.)

Each window is associated with one cylinder. (Therefore, for an engine comprising 6 cylinders, there will be 50/6 windows per second per cylinder.)

Injecting 250 $mm^3$ $s^{-1}$ may be achieved by injecting the minimum volume reliably achievable by each fuel injector (5 $mm^3$) at every one of the 50 windows per second. (5 $mm^3$×50 windows per second=250 $mm^3$ $s^{-1}$.)

Example 3

In a third example, a 6-cylinder engine may be rotating at 2000 rpm and the amount of fuel to be injected may be 200 $mm^3$ $s^{-1}$. The minimum volume of fuel reliably injectable per injector may be 5 $mm^3$.

As stated above, for an engine rotating at 2000 rpm, there will be 100 fuel injection windows per second for the injection of fuel intended to remain unburnt in the cylinders. Each of these windows is associated with one cylinder. Achieving a flow rate of 200 $mm^3$ $s^{-1}$ may be possible by injecting 5 $mm^3$ (the minimum volume of fuel reliably injectable per injector) on only 40 of the 100 windows. This represents a desired fractional value of 2/5 (=40/100). Interpretation of this desired fractional value in implementing the method of the disclosure is explained below.

Example 4

In a fourth example, a 6-cylinder engine may be rotating at 1000 rpm and the amount of fuel to be injected may be 20 $mm^3$ $s^{-1}$. The minimum volume of fuel reliably injectable per injector may be 5 $mm^3$.

As stated above, for an engine rotating at 1000 rpm, there will be 50 fuel injection windows per second for the injection of fuel intended to remain unburnt in the cylinders. Each of these windows is associated with one cylinder.

Achieving a flow rate of 20 $mm^3$ $s^{-1}$ may be possible by injecting 5 $mm^3$ (the minimum volume of fuel reliably injectable per injector) on only 4 of the 50 windows. This represents a desired fractional value of 2/25 (=4/50). Interpretation of this desired fractional value in implementing the method of the disclosure is explained below.

In order to provide a method of converting a desired quantity of fuel per second into instructions to inject fuel at particular possible injection windows, it may be helpful to provide a limited number of possible fuel injection sequences, saved in memory, to be called upon dependent on different engine parameters (i.e. required flow rate and engine speed). These injection sequences may be used when the required volume of fuel to be injected cannot be achieved by injecting the minimum volume of fuel at every injection window (i.e. where, in the examples provided above, a desired fractional value (rather than integer value) results).

Since the number of injection windows per second changes (i.e. with engine speed) and in order to reduce the amount of memory required for storing injection sequences and the amount of processing required to select and retrieve a particular stored injection sequence, it may be desirable to provide a relatively small number of possible injection sequences (i.e. fewer than the number of fuel injection windows per second when running at average engine speed) and to identify each sequence by one of a range of nominal fractional values. The method may involve selecting a sequence associated with the nominal fractional value (of the range of nominal fractional values) which is closest to the desired fractional value. Alternatively, rather than selecting on the basis of the closest nominal fractional value from the range of nominal fractional values, it may be desirable to choose the next nominal fractional value larger than the desired fractional value or the next nominal fractional value smaller than the desired fractional value, even though that nominal fractional value may not be the closest of the range of nominal fractional values to the desired fractional value.

The method may involve a "possible injection window count" wherein the number of injection event sequences is the same as the maximum possible injection window count value. Each complete injection event sequence may represent one of the nominal fractional values.

FIG. 2 shows a 13×13 matrix in accordance with a specific embodiment of the disclosure. Each column of the 13×13 matrix represents an injection event sequence. The injection event sequence is populated by a sequence of 1s and 0s, wherein 1 represents an instruction to inject fuel at that point in the sequence and 0 represents either an instruction not to inject fuel or an absence of an instruction to inject fuel at that point in the sequence. Since the matrix of FIG. 2 comprises 13 columns, the matrix comprises 13 injection event sequences. Each column of the matrix is associated with a nominal fractional value from a range of nominal fractional values. The nominal fractional values represent 13 largely equally spaced fractions between 0 and 1. (In this example, the interval between each nominal fractional value is the same (i.e. 1/13), but the interval between 0 and the smallest nominal fractional value and the interval between the largest nominal fractional value and 1 are each half that of the spacing between the nominal fractional values (i.e. 1/26).)

The matrix may be used where the volume of fuel to be injected per time period (i.e. 200 $mm^3$ $s^{-1}$, in Example 3 above) is not an exact multiple of a product (i.e. 500 $mm^3$ $s^{-1}$) of the number of possible injection windows per time period (i.e. 100 $s^{-1}$) and the minimum reliably, injectable fuel volume per injector (i.e. 5 $mm^3$). Put another way, using the language of Examples 1 to 4 above, the matrix may be used where the analysis results in a non-zero desired fractional value indicating that not all possible injection windows require an injection (i.e. Example 3 where the desired fractional value is 2/5 and Example 4 where the desired fractional value is 2/25).

In the case of Example 3, dividing the volume of fuel to be injected (200 $mm^3$ $s^{-1}$) by the product (500 $mm^3$ $s^{-1}$) gives a desired fractional value of 2/5. The method may involve identifying a column of the matrix associated with a nominal fractional value closest to the desired fractional value of 2/5 (=0.4). In this case, the closest nominal fractional value of the range of nominal fractional values is 11/26 (=0.42). By using the sequence associated with the nominal fractional value 11/26, 5 out of 13 possible injection windows (i.e. the "1s" in the column associated with the nominal fractional value 11/26) may be caused to have a 5 $mm^3$ injection of fuel while the remaining 8 out of 13 possible injection windows (i.e. the "0s" in the column associated with the nominal fractional value 11/26) may be caused to have no injection of fuel.

Assuming that the engine speed (2000 rpm) and the volume of fuel required per time period (500 $mm^3$ $s^{-1}$) remain constant then the injection sequence associated with the nominal fractional value 11/26 remains appropriate and the injection sequence of that column may be used continuously to dictate which of the possible injection windows involves an injection (of 5 $mm^3$) and which of the possible injection windows does not involve an injection. It would be evident to the skilled person that if a parameter (i.e. engine speed, required flow rate of fuel) changes then the previous injection sequence may no longer be suitable.

The count (in this case 1 to 13) may count through each cylinder (injector) in turn. Thus, count 1 may be associated with cylinder 1, count 2 may be associated with cylinder 2, count 3 may be associated with cylinder 3, count 4 may be associated with cylinder 4, count 5 may be associated with cylinder 5, and count 6 may be associated with cylinder 6. It follows that count 7 may be associated with cylinder 1, count 8 may be associated with cylinder 2, count 9 may be associated with cylinder 3, count 10 may be associated with cylinder 4, count 11 may be associated with cylinder 5, and count 12 may be associated with cylinder 6. It further follows that count 13 may be associated with cylinder 1. The count then continues with the next cylinder in the sequence. As such, count 1 may be associated with cylinder 2, count 2 may be associated with cylinder 3, etc. . . .

In this manner, for a particular injection event sequence (i.e. that associated with nominal fractional value 11/26) it will not always be the same cylinders which are and/or are not receiving an injection. In the particular case of 6 cylinders and 13 count values, for each successive cycle through the 13 count values, the cylinder associated with each count value will increment with each cycle through the count values. This may have the advantage that, over a large number of possible injection windows (i.e. 10,000), all cylinders receive approximately the same number of injections regardless of engine speed and regardless of volume of fuel to be injected per time period.

Furthermore, an advantage of the method of the present disclosure may be that when there is a step change requirement in the injection requirements (perhaps as a consequence of a sudden change in engine speed or a sudden change in volume of fuel to be injected per time period, or both) it is possible to move progressively through the injection sequences in order to achieve a smoother transition.

For example, if the nominal fractional value required at a first moment in time is 21/26 and the nominal fractional value required at a second moment in time is 9/26, it may be desirable to select the injection sequences associated with the some or all of the intermediate nominal fractional values when moving between that associated with 21/26 and that associated with 9/26. That is to say, the injection sequence may move from that associated with 21/26, via that associated with 19/26, that associated with 17/26, that associated with 15/26, that associated with 13/26 and that associated with 11/26 before arriving at that associated with 9/26. This may result in smoother operation of the engine and/or any aftertreatment apparatus. Alternatively, for a faster transition, the injection sequence may move from 21/26 to 9/26 via only 17/26 and 13/26, for example.

As may be seen, for example, from the 9/26 column of the matrix, the 1s and 0s may be evenly distributed, while maintaining the overall ratio of 1s to 0s (4:9, in the example of the 9/26 column). The even distribution may be a feature of all columns, though each column maintains its appropriate ratio of 1s to 0s depending on the nominal fractional value associated with the respective column.

While the above example uses a square (13×13) matrix, it is not essential that the matrix be square. For example, the matrix may comprise p columns and a multiple of p (i.e. mp) rows. Whether the matrix is square or not, the ratio of 1s to 0s in each column may be apportioned according to the nominal fractional value associated with the particular column. Where m>1, rows 1 to p may have a different order of 1s and 0s from rows p+1 to 2p, albeit maintaining a roughly even distribution of 1s and 0s whilst also maintaining the ratio of 1s and 0s appropriate to the nominal fractional value associated with the column as described above. This may allow more options for variation in the pattern of 1s and 0s in each column. This may result in more variation, with time, in the cylinders receiving shots of fuel for a given nominal fractional value.

In some situations, it may be that the flow rate of fuel required per second is such that one fuel injection of the minimum volume reliably achievable for every cylinder will be less than that necessary to achieve the desired flow rate. Such a situation might be said to result in a desired fractional value of greater than 1 or alternatively an integer number plus a desired fractional value (i.e. a "remainder") of between 0 and 1. In such cases, it may be that multiple injections per cylinder are made per fuel injection window.

The following are examples of how it may be possible to determine how to achieve a desired flow rate when that rate is more that that achievable by injecting into every cylinder the minimum volume reliably achievable by each injector.

Example 5

For example, a 6-cylinder engine may be rotating at 2000 rpm and the amount of fuel to be injected may be 1500 $mm^3 s^{-1}$. The minimum volume of fuel reliably injectable per injector may be 5 $mm^3$.

As stated above (see Examples 1 and 3), for an engine rotating at 2000 rpm, there will be 100 fuel injection windows per second for the injection of fuel intended to remain unburnt in the cylinders. Each of these windows is associated with one cylinder.

Injecting 1500 $mm^3 s^{-1}$ may be achieved by injecting the minimum volume reliably achievable by each fuel injector (5 $mm^3$) 300 times per second. Given that there are only 100 windows per second, this volume of injection may be achieved by injecting 3×5 $mm^3$ shots (in succession) into the particular cylinder during each of the 100 fuel injection windows.

In this situation, therefore, there is no desired fractional value (because 1500 $mm^3 s^{-1}$ is an exact multiple of 500 $mm^3$ and hence there is no "remainder" as a result of the division calculation) and so it may not be necessary to consult the matrix in order to determine a fuel injection sequence.

Example 6

By way of further example, a 6-cylinder engine may be rotating at 2000 rpm and the amount of fuel to be injected may be 1200 $mm^3 s^{-1}$. The minimum volume of fuel reliably injectable per injector may be 5 $mm^3$.

As stated above, for an engine rotating at 2000 rpm, there will be 100 fuel injection windows per second for the injection of fuel intended to remain unburnt in the cylinders. Each of these windows is associated with one cylinder.

Injecting 1200 $mm^3 s^{-1}$ may be achieved by injecting the minimum volume reliably achievable by each fuel injector (5 $mm^3$) 240 times per second. Given that there are only 100 windows per second, this volume of injection may be achieved by injecting either 2 or 3 shots (in succession) into the particular cylinder during each fuel injection window. For 60 of the 100 fuel injection windows the number of shots will be 2, for a further 40 of the 100 fuel injection windows the number of shots will be 3. (Calculated by (60×2)+(40×3)=240.) The matrix may be used to determine the fuel injection sequence in respect of the possible $3^{rd}$ shot only. In other words, the matrix may not affect the first 2 shots per injection window (since every cylinder receives at least 2 shots). However, the matrix may be used to determine in which possible fuel injection windows the possible third shot is injected.

In more general terms (the numbers in brackets relating to those used in FIG. 6 above), this aspect of the method may involve dividing the volume of fuel to be injected per time period (1200 $mm^3 s^{-1}$) by the product (500 $mm^3 s^{-1}$) of the number of possible injection windows per time period (100 $s^{-1}$) and the first injectable fuel volume (5 $mm^3$) to arrive at a quotient (i.e. an integer number) (2) and a "remainder" (=desired fractional) value (2/5). The quotient indicates the minimum number of shots (2) to be injected during each fuel injection window and the remainder indicates the desired fractional value of fuel injection windows (2/5) which will have the minimum number of shots plus 1 (i.e. 2+1=3).

The matrix may be used to identify the fuel injection sequence in respect of the remainder shots only. The matrix is not necessary for determining the injection sequence related to the quotient value since non-zero quotient values result in at least one shot for every fuel injection window.

In the alternative, it may be that the volume related to a quotient value (i.e. 2×5 $mm^3$) might be delivered as a single (i.e. 10 $mm^3$) shot.

A series of multiple 5 $mm^3$ shots may be desirable if seeking to minimise fuel being sprayed onto internal walls of the cylinder (which may result in that fuel remaining in the cylinder rather than passing through). One or more larger initial shots per window (i.e. an initial shot of 10 $mm^3$) may be desirable if the duration of the window is short so as not to allow sufficient time for multiple shots.

The method of the disclosure may also involve the possibility of having one or more cylinders of the engine inactive for the purposes of injecting fuel to pass through the engine unburnt. For example, in a 6-cylinder engine it may be desirable to use only 5 of the 6 cylinders for the purposes of passing fuel unburnt through the engine. In this case, the possible injection windows associated with the inactive cylinder would not be available. In addition, the one inactive cylinder would not participate in the count.

For example, the sixth cylinder may be inactive and may not therefore participate in the count. The count (e.g. 1 to 13) may count through each active cylinder (injector) in turn (i.e. only 5 of the 6 cylinders). Thus, count 1 may be associated with cylinder 1, count 2 may be associated with cylinder 2, count 3 may be associated with cylinder 3, count 4 may be associated with cylinder 4, and count 5 may be associated with cylinder 5. Cylinder 6 is inactive and no count is associated with cylinder 6. It follows that count 6 may be associated with cylinder 1, count 7 may be associated with cylinder 2, count 8 may be associated with cylinder 3, count 9 may be associated with cylinder 4, and count 10 may be associated with cylinder 5. Again, no count is associated with cylinder 6 since it is inactive. It further follows that count 11 may be associated with cylinder 1, count 12 may be associated with cylinder 2 and count 13 may be associated with cylinder 3. The count then continues with the next cylinder in the sequence. As such, count 1 may be associated with cylinder 4, count 2 may be associated with cylinder 5, etc. . . .

Where one cylinder is in active it follows that the number of possible injection windows is reduced. For a 6-cylinder engine having 1 inactive cylinder, the number of possible injection windows per second is reduced by 1/6. It is also possible that more than one cylinder may be inactive.

As the skilled person will readily appreciate, the disclosure is not limited to the examples illustrated herein. For example, the disclosure is not limited to any of the following:

a 6-cylinder engine;

a 5 $mm^3$ minimum reliable injection volume;

a maximum possible injection window count value of 13;

any specific engine speeds; or any other specific numeral.

FIG. 3 shows a p×p matrix where p might be any integer value and wherein successive injection events are labelled $x_1, x_2, x_3 \ldots x_{p-1}, x_p$. However, as the skilled person would again appreciate, the disclosure is not to be seen to be limited to this (albeit more generalised) square matrix. For example, the range of nominal fractional values may be distributed differently (albeit increasing successively from ~0 to ~1). In any case, as described above, it may not be a requirement of the method of the disclosure for the matrix to be square.

In this disclosure, the terms "column" and "row" are used in the context of a matrix. As the skilled person would readily understand, columns are not limited to those which are vertically disposed in the matrix and rows are not limited to those which are horizontally disposed in the matrix. The matrix may be rotated through 90° such that rows become columns and columns become rows, respectively, without falling outside the scope of the disclosure. Columns of the matrix may alternatively be labelled first dimensions of the matrix and rows may alternatively be labelled second dimensions of the matrix. In any case, as the skilled person would also appreciate, when stored on physical media, the matrix may not be arranged in columns and rows in any conventional sense.

In this disclosure, the term "nominal fractional value" is not intended (necessarily) to mean that the value is nominal in the sense of insignificantly small. Rather, the term nominal is used in the sense that each column of the matrix may have a "named" fractional value. This is to distinguish from an actual fractional value which might be defined as a proportion of 1s in the fuel injection sequence associated with the nominal fractional value.

The invention claimed is:

1. A method of controlling injection of a volume of fuel to be injected per time period within a combustion engine having a plurality of cylinders, each cylinder having an associated fuel injector, each fuel injector able to deliver a first injectable fuel volume, wherein each time period comprises a number of possible injection windows, and each possible injection window is associated with one of the plurality of cylinders, wherein each possible injection window is associated with an integer count value, x, between 1 and mp, wherein each of m and p is an integer and wherein x increments by 1 for each possible injection window and wherein mp to is a multiple of 1, the method involving use of a matrix having p columns and mp rows wherein each row of the matrix is associated with one of the integer count values from 1 to mp, each column of the matrix is associated with a fraction value, and each column of the matrix comprises an injection sequence associated with its fraction value, the method comprising:

determining whether it is true or false that the volume of fuel to be injected per time period is an exact multiple of a product of the number of possible injection windows per time period and the first injectable fuel volume; and when it is determined to be false, identifying a column of the matrix associated with a fraction value which is close to a remainder value obtained by dividing the volume of fuel to be injected per time period by the product of the number of possible injection windows per time period and the first injectable fuel volume, and using the injection sequence of said column to determine in which of a next mp possible injection windows to inject the first injectable fuel volume.

2. The method of claim 1 wherein each position in the matrix is populated by one of a pair of binary values, wherein a first of the pair of binary values comprises an instruction to inject fuel and a second of the pair of binary values comprises either:

an instruction not to inject fuel; or the absence of an instruction to inject fuel.

3. The method of claim 1 wherein the integer multiple m is 1 such that the matrix is a p×p matrix.

4. The method of claim 1 wherein p is greater than the number of cylinders.

5. The method of claim 1 wherein p is not an exact multiple of the number of cylinders.

6. The method of claim 1 wherein p is a prime number.

7. The method of claim 2 wherein, for each injection sequence, the first of the pair of binary instruction values are distributed evenly among the second of the pair of binary instruction values in accordance with a desired fractional of the first pair of binary instruction values to the second pair of binary instruction values in the particular injection sequence.

8. The method of claim 1 wherein the fraction values are either:

$$\frac{1}{p}, \frac{2}{p}, \frac{3}{p} \cdots \frac{p-1}{p}, \frac{p}{p}; \text{or}$$

$$\frac{2x_1-1}{2p}, \frac{2x_2-1}{2p}, \frac{2x_3-1}{2p} \cdots \frac{2x_{p-1}-1}{2p}, \frac{2x_p-1}{2p}$$

wherein $x_1, x_2, x_3 \ldots x_{p-1}, x_p$ represent each of the integer count values, 1 to p.

9. The method of claim 2 wherein the injection sequence associated with a smallest fraction comprises exactly one of the first of the pair of binary values, and for each increasing fraction of the fraction values the associated injection sequence comprises an additional one of the first of the pair of binary values such that the injection sequence associated with a largest fraction comprises exclusively the first of the pair of binary values.

10. The method of claim 2 wherein the injection sequence associated with a smallest fraction comprises exclusively the second of the pair of binary values, and for each increasing fraction of the fraction values the associated injection sequence comprises an additional one of the first of the pair of binary values such that the injection sequence associated with a largest fraction comprises exactly one of the second pair of binary values.

11. The method of claim 1 wherein the first injectable fuel volume is a minimum injectable fuel volume which can reliably be injected by each injector.

12. The method of claim 1 wherein each fuel injector is able to deliver a secondary injectable fuel volume which represents a greater volume than the first injectable fuel volume.

13. The method of claim 12 wherein the secondary injectable fuel volume is injected only when the volume of fuel to be injected per time period is greater than the product of the number of possible injection windows per time period and the first injectable fuel volume.

14. The method of claim 1 wherein the step of identifying the column of the matrix associated with the fraction value which is close to the remainder value involves either:

identifying a fraction value which is closest to the remainder value;

identifying a fraction value which is immediately higher than the remainder value; or identifying a fraction value which is immediately lower than the remainder value.

15. The method of claim 1 wherein p is 13 and the number of cylinders is 4 or 6.

16. The method of claim 2 wherein the integer multiple m is 1 such that the matrix is a p×p matrix.

17. The method of claim 2 wherein p is greater than the number of cylinders.

18. The method of claim 2 wherein p is not an exact multiple of the number of cylinders.

19. The method of claim 2 wherein p is a prime number.

20. The method of claim 2 wherein the fraction values are either:

$$\frac{1}{p}, \frac{2}{p}, \frac{3}{p} \cdots \frac{p-1}{p}, \frac{p}{p}; \text{ or}$$

$$\frac{2x_1-1}{2p}, \frac{2x_2-1}{2p}, \frac{2x_3-1}{2p} \cdots \frac{2x_{p-1}-1}{2p}, \frac{2x_p-1}{2p}$$

wherein $x_1, x_2, x_3 \ldots x_{p-1}, x_p$ represent each of the integer count values, 1 to p.

* * * * *